US010584406B2

(12) United States Patent
Imamura et al.

(10) Patent No.: US 10,584,406 B2
(45) Date of Patent: Mar. 10, 2020

(54) ELECTRICAL STEEL SHEET

(71) Applicant: JFE Steel Corporation, Tokyo (JP)

(72) Inventors: Takeshi Imamura, Tokyo (JP); Minoru Takashima, Tokyo (JP); Tatsuhiko Hiratani, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 874 days.

(21) Appl. No.: 14/373,973

(22) PCT Filed: Jan. 22, 2013

(86) PCT No.: PCT/JP2013/051200

§ 371 (c)(1),
(2) Date: Jul. 23, 2014

(87) PCT Pub. No.: WO2013/111751

PCT Pub. Date: Aug. 1, 2013

(65) Prior Publication Data

US 2015/0013850 A1 Jan. 15, 2015

(30) Foreign Application Priority Data

Jan. 27, 2012 (JP) ..... 2012-015053

(51) Int. Cl.

| | |
|---|---|
| ***H01F 1/147*** | (2006.01) |
| ***C22C 38/34*** | (2006.01) |
| ***C22C 38/44*** | (2006.01) |
| ***C22C 38/42*** | (2006.01) |
| ***C22C 38/60*** | (2006.01) |
| ***C22C 38/00*** | (2006.01) |
| ***C22C 38/22*** | (2006.01) |
| ***C21D 8/12*** | (2006.01) |
| ***C22C 38/02*** | (2006.01) |
| ***H01F 1/16*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/16*** | (2006.01) |
| ***C22C 38/20*** | (2006.01) |

(52) U.S. Cl.

CPC ..... *C22C 38/22* (2013.01); *C21D 8/12* (2013.01); *C22C 38/00* (2013.01); *C22C 38/002* (2013.01); *C22C 38/004* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/16* (2013.01); *C22C 38/20* (2013.01); *C22C 38/34* (2013.01); *C22C 38/42* (2013.01); *C22C 38/44* (2013.01); *C22C 38/60* (2013.01); *H01F 1/16* (2013.01); *C21D 2201/05* (2013.01); *H01F 1/14775* (2013.01); *H01F 1/14791* (2013.01)

(58) Field of Classification Search

CPC ..... C21D 2201/05; C21D 8/12; C22C 38/00; C22C 38/002; C22C 38/004; C22C 38/008; C22C 38/02; C22C 38/04; C22C 38/06; C22C 38/08; C22C 38/12; C22C 38/16; C22C 38/18; C22C 38/20; C22C 38/22

See application file for complete search history.

(56) References Cited

U.S. PATENT DOCUMENTS

| | | | | |
|---|---|---|---|---|
| 5,354,389 | A * | 10/1994 | Arai | C21D 8/1233 148/111 |
| 2002/0134466 | A1 * | 9/2002 | Namikawa | C21D 8/1255 148/113 |

FOREIGN PATENT DOCUMENTS

| | | | |
|---|---|---|---|
| EP | 0 987 341 | | 3/2000 |
| JP | 5-65537 | A | 3/1993 |
| JP | 5-49745 | B2 | 7/1993 |
| JP | 5-279813 | A | 10/1993 |
| JP | 6-57853 | B2 | 8/1994 |
| JP | 8-134606 | A | 5/1996 |
| JP | 11-199988 | A | 7/1999 |
| JP | 11-209852 | A | 8/1999 |
| JP | 2000-178647 | A | 6/2000 |
| JP | 3948112 | B2 | 4/2007 |
| JP | 3948113 | B2 | 4/2007 |
| JP | 2007-204787 | A | 8/2007 |
| JP | 2007204787 | A * | 8/2007 |
| JP | 4073075 | B2 | 2/2008 |

(Continued)

OTHER PUBLICATIONS

Supplementary European Search Report dated Sep. 3, 2015 of corresponding European Application No. 13741435.5.

(Continued)

*Primary Examiner* — Jenny R Wu
(74) *Attorney, Agent, or Firm* — DLA Piper LLP (US)

(57) ABSTRACT

An electrical steel sheet has a composition including C: less than 0.010 mass %, Si: 1.5~10 mass % and the balance being Fe and incidental impurities, wherein a main orientation in a texture of a steel sheet is <111>//ND and an intensity ratio relative to randomly oriented specimen of the main orientation is not less than 5 and, preferably an intensity ratio relative to randomly oriented specimen of {111}<112> orientation is not less than 10, an intensity ratio relative to randomly oriented specimen of {310}<001> orientation is not more than 3 and Si concentration has a gradient that it is high at a side of a surface layer and low at a central portion in the thickness direction and a maximum value of the Si concentration is not less than 5.5 mass % and a difference between maximum and minimum values is not less than 0.5 mass %.

8 Claims, 1 Drawing Sheet

(56) References Cited

FOREIGN PATENT DOCUMENTS

| | | | | |
|---|---|---|---|---|
| JP | 2008-189976 | A | | 8/2008 |
| JP | 2009-256758 | A | | 11/2009 |
| JP | 2011-089170 | A | | 5/2011 |
| JP | 2011089170 | A | * | 5/2011 |

OTHER PUBLICATIONS

First Notification of Office Action dated Aug. 20, 2015 of corresponding Chinese Application No. 201380005720.0 along with an English translation.

Tanaka, I., et al., "Magnetic Properties and Recrystallization Texture Evolutions of Phosphorus-bearing Non-oriented Electrical Steel Sheets," *ISIJ International*, 2007, vol. 47, No. 11, pp. 1666-1671.

Notice of Grounds for Rejection dated Aug. 17, 2015 of corresponding Korean Patent Application No. 2014-7012662 along with an English translation.

Japanese Office Action dated Jun. 29, 2015 along with an English translation from corresponding Japanese Patent Application No. 2012-015053.

* cited by examiner

ELECTRICAL STEEL SHEET

TECHNICAL FIELD

This disclosure relates to an electrical steel sheet used in a core material for a reactor or the like excited at a high frequency.

BACKGROUND

In general, it is known that an iron loss of the electrical steel sheet drastically rises as an excitation frequency becomes higher. However, the drive frequency of a transformer or a reactor is actually increased to make the size of an iron core small and efficiency thereof high. Therefore, heat generation due to the iron loss of the electrical steel sheet frequently becomes problematic.

A method of increasing Si content to enhance an intrinsic resistance of steel is effective to reduce the iron loss of the steel sheet. However, when the Si content in steel exceeds 3.5 mass %, workability considerably degrades. Hence, it is difficult to produce the electrical steel sheet by a production method utilizing a conventional rolling process. Therefore, various methods are proposed to produce steel sheets with a high Si content. For example, JP-B-H05-049745 discloses a method wherein siliconizing is carried out by blowing a non-oxidizing gas containing $SiCl_4$ onto a surface of a steel sheet at a temperature of 1023~1200° C. to provide an electrical steel sheet having a high Si content. Also, JP-B-H06-057853 discloses a method wherein a steel sheet having a high Si content of 4.5~7 mass % and being poor in the workability is continuously hot rolled under appropriate rolling conditions to obtain a hot rolled steel sheet having a good cold rolling property.

As a method of reducing the iron loss except for the increase of the Si content, it is effective to reduce the thickness of the sheet. When the steel sheet is produced by a rolling process of a high-Si steel as a raw material, there is a limit in the reduction of the sheet thickness. To this end, there has been developed and already commercialized a method wherein a low-Si steel is cold rolled to a given final thickness and, thereafter, siliconized in a $SiCl_4$-containing atmosphere to increase Si content in steel. Since it is made possible to give a gradient to the Si concentration in the thickness direction, this method is disclosed to be effective in the reduction of the iron loss at a high excitation frequency (see Japanese Patent Nos. 3948113, 3948112 and 4073075).

When the electrical steel sheet is used as a core material for a reactor, the iron loss property is important as mentioned above, but a DC superimposition property also becomes very important. The term "DC superimposition property" means a characteristic of lowering inductance when an excitation current of the core is increased. It is characteristically preferable that a reducing margin of the inductance is small even when the current is increased.

In the core using the electrical steel sheet, a gap (air gap) is formed in the core to improve the DC superimposition property. That is, the DC superimposition property is adjusted by designing the core instead of changing the characteristics of the electrical steel sheet itself. However, it is recently demanded to further improve the DC superimposition property. Because, the improvement of the DC superimposition property can decrease the core body and causes a merit capable of decreasing the volume and the weight. Especially, the decrease of the weight in the core mounted on a hybrid car or the like leads in the improvement of fuel consumption as it is so that it is strongly desired to improve the DC superimposition property.

However, there is substantially no approach to improve the DC superimposition property of the electrical steel sheet itself until now. Hence, the improvement is actually dependent upon the design of the core as mentioned above.

It could therefore be helpful to provide electrical steel sheets capable of improving the DC superimposition property of the core excited at a high frequency.

SUMMARY

We found that the DC superimposition property of the core can be improved by setting an adequate texture of a steel sheet and rendering a main orientation in the texture of the steel sheet into <111>//ND.

We thus provide an electrical steel sheet having a chemical composition comprising C: less than 0.010 mass %, Si: 1.5~10 mass % and the balance being Fe and incidental impurities, wherein a main orientation in a texture of a steel sheet is <111>//ND and an intensity ratio relative to randomly oriented specimen (hereinafter referred to as "an intensity") of the main orientation is not less than 5.

The electrical steel sheet is characterized in that an intensity of {111}<112> orientation is not less than 10.

The electrical steel sheet is characterized in that an intensity of {310}<001> orientation is not more than 3.

Also, the electrical steel sheet is characterized in that Si concentration has a gradient that it is high at a side of a surface layer and low at a central portion in the thickness direction and a maximum value of the Si concentration is not less than 5.5 mass % and a difference between maximum value and minimum value is not less than 0.5 mass %.

In addition to the above chemical composition, the electrical steel sheet contains one or more of Mn: 0.005~1.0 mass %, Ni: 0.010~1.50 mass %, Cr: 0.01~0.50 mass %, Cu: 0.01~0.50 mass %, P: 0.005~0.50 mass %, Sn: 0.005~0.50 mass %, Sb: 0.005~0.50 mass %, Bi: 0.005~0.50 mass %, Mo: 0.005~0.100 mass % and Al: 0.02~6.0 mass %.

The electrical steel sheet having an excellent DC superimposition property can be provided by setting an adequate texture of the steel sheet. Therefore, a reactor core having an excellent iron loss property at a high frequency even in a small body can be realized by using the electrical steel sheet as a core material.

DETAILED DESCRIPTION

Experiments concerning our steel sheets and methods will be described below.

A steel slab containing C: 0.0044 mass % and Si: 3.10 mass % is heated to 1200° C., hot rolled to obtain a hot rolled sheet of 2.4 mm in thickness, and then cold rolled to a final thickness of 0.10 mm under the following three conditions A~C:

Condition A: The hot rolled sheet is subjected to a hot band annealing of 1000° C.×100 seconds and then subjected to cold rolling twice, wherein an intermediate thickness of 1.0 mm is attained at the first cold rolling and the final thickness of the cold rolled sheet of 0.10 mm is attained at the second cold rolling after an intermediate annealing of 1000° C.×30 seconds.

Condition B: The hot rolled sheet is subjected to a hot band annealing of 1000° C.×100 seconds and then subjected to a single cold rolling to obtain a cold rolled sheet having a final thickness of 0.10 mm.

Condition C: The hot rolled sheet is subjected to a single cold rolling to obtain a cold rolled sheet having a final thickness of 0.10 mm without a hot band annealing.

Then, the above three cold rolled sheets are subjected to siliconizing (final annealing) of 1200° C.×120 seconds in an atmosphere of 10 vol % $SiCl_4$+90 vol % $N_2$ to obtain steel sheets having a uniform Si content in thickness direction of 6.5 mass %.

A core for a reactor is prepared by using each of the thus obtained three steel sheets, and a DC superimposition property thereof is measured by a method described in JIS C5321. Moreover, the core for the reactor has a weight of 900 g and is provided in two places with a gap of 1 mm.

Figure 1:
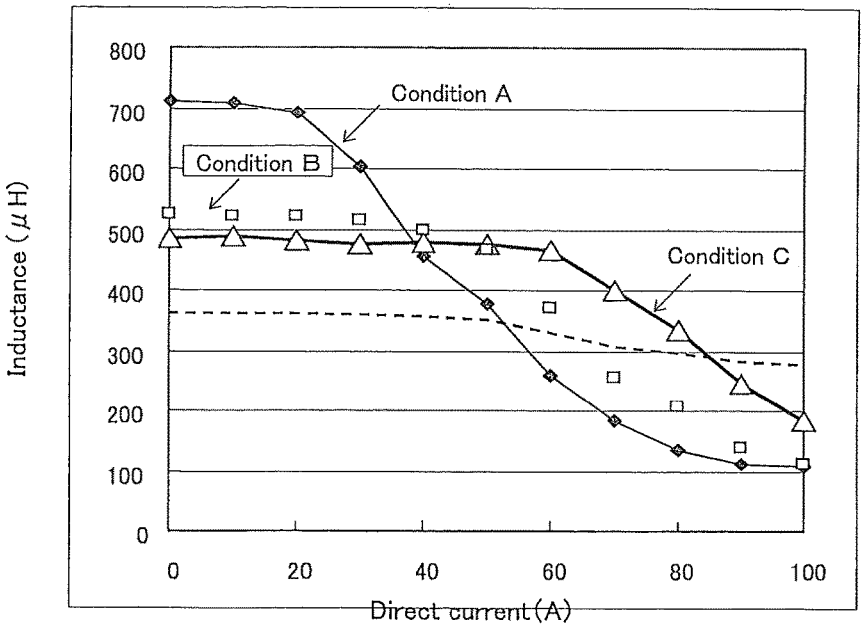
FIG. 1 is a graph showing a change of a DC superimposition property of a reactor core based on difference of production methods.

FIG. 1 shows results measured on the DC superimposition property. As seen from these results, the DC superimposition property can be changed by varying production conditions of the steel raw material, and the steel sheet produced under the condition C among the above production conditions A~C is smallest in the reducing margin of inductance associated with the increase of direct current, i.e., the steel sheet produced under the condition C has a best DC superimposition property.

Figure 2:
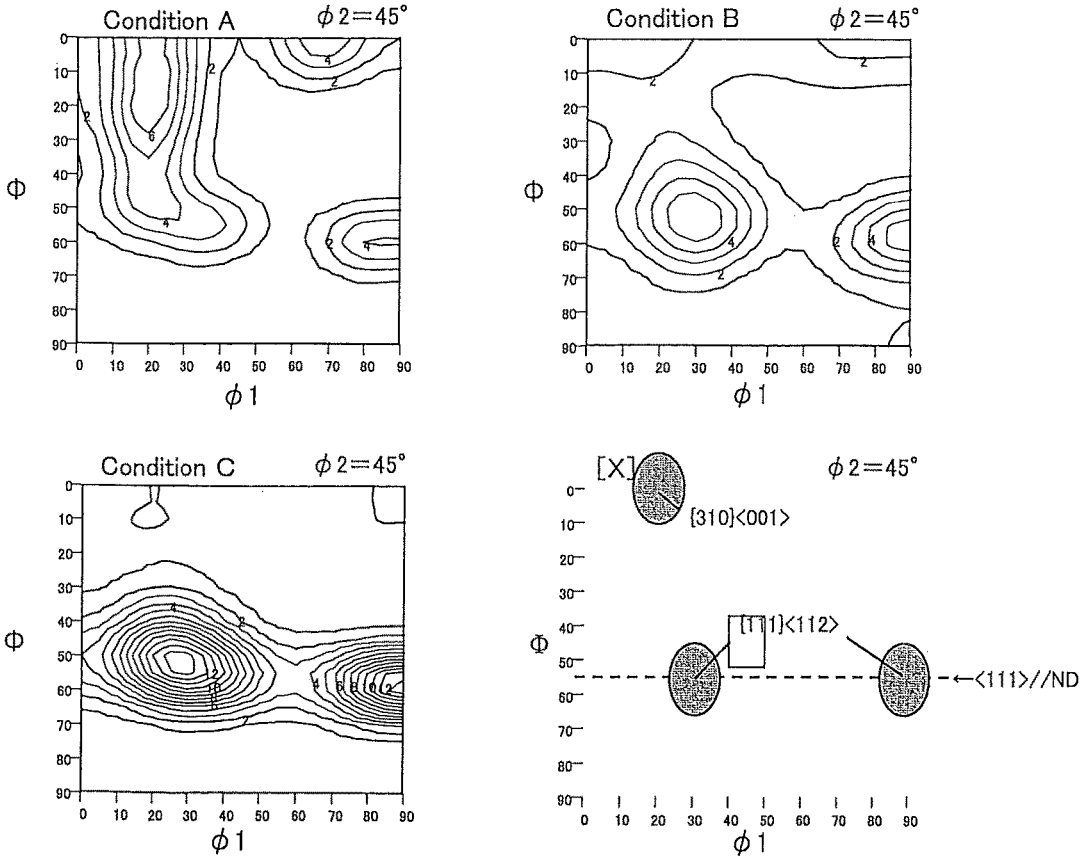
FIG. 2 is a view (Bunge's ODF, $\phi 2=45°$ section) showing a change of a texture in a sheet product based on difference of production methods.

The texture on the surface layer portion of the steel sheet is investigated by X-ray diffraction pole figure analysis and its ODF is calculated from the thus obtained data by the discrete method to obtain results shown in FIG. 2. Moreover, [X] shown in FIG. 2 is a view illustrating ideal orientations of the texture.

In the steel sheet produced under the condition C for the good DC superimposition property, it should be noted that <111>//ND orientation is highly developed and particularly {111}<112> orientation has a high peak. On the other hand, the DC superimposition property is good as {310}<001> orientation becomes smaller. Moreover, ND means a normal direction to the surface of the sheet.

Although the reason why the DC superimposition property is changed by varying the texture of the steel sheet is not clear sufficiently, we believe it is as follows.

As previously mentioned in a conventional technique, a gap is formed in the core to improve the DC superimposition property. Formation of the gap makes excitation of the core definitely difficult. As a result of the investigation on the above experiments, <111>//ND orientation develops remarkably in the steel sheet produced under the condition C providing the good DC superimposition property, which is an orientation existing no <100> axis on the sheet surface as an axis of easy magnetization, i.e., a hardly-magnetizable orientation in an excitation direction. Therefore, the difficulty of the excitation is considered to improve the DC superimposition property. In view of such a consideration, since {310}<001> orientation has an axis of easy magnetization on the sheet surface, it can be explained that as this orientation becomes less, the DC superimposition property is good.

Evaluation of the DC superimposition property is conducted at a direct current value when an inductance is down by half from an initial inductance value (inductance at a direct current of 0 [A]). When this evaluation standard is applied to FIG. 1, the direct current value is 52 [A] in the steel sheet produced under the condition A, 69 [A] in the steel sheet produced under the condition B, and 90 [A] in the steel sheet produced under the condition C, respectively, from which it is clear that the steel sheet produced under the condition C is best in the DC superimposition property.

The chemical composition of the electrical steel sheet (product sheet) will be described below.

The electrical steel sheet is necessary to have a chemical composition comprising C: less than 0.010 mass % and Si: 1.5~10 mass %.

C: Less than 0.010 Mass %

C causes magnetic aging and degrades magnetic properties so that it is desirable to make the content small. However, excessive reduction of C content increases the production cost. Therefore, the C content is limited to less than 0.010 mass % in which the magnetic aging is practically out of the question. Preferably, it is less than 0.0050 mass %.

Si: 1.5~10 Mass %

Si is an essential element enhancing specific resistance of steel and improving the iron loss property. It is necessary to be included in a content of not less than 1.5 mass % to obtain the above effects. However, when the content exceeds 10 mass %, saturation magnetic flux density decreases remarkably, which rather brings about deterioration of the DC superimposition property. Therefore, Si content is 1.5~10 mass %. Moreover, the Si content is an average value in a full sheet thickness.

The power source used in the reactor is usually a high-frequency power source. So, the Si content is preferable to be not less than 3 mass % among the above range from a viewpoint of the improvement of high-frequency iron loss property. More preferably, it is not less than 6.0 mass %. On the other hand, the upper limit of the Si content is preferable to be 7 mass % in view of ensuring high saturation magnetic flux density.

It is also preferable that the Si concentration has a gradient that it is high at a side of a surface layer and low at a central portion in the thickness direction and a maximum value of the Si concentration is not less than 5.5 mass % and a difference between maximum value and minimum value is not less than 0.5 mass %. The magnetic flux has a nature of concentrating near to the surface of the steel sheet at a high frequency. Thus, it is desirable to make the Si concentration higher at the side of the surface layer in the sheet thickness in view of reducing the iron loss at the high frequency. Further, the crystal lattice is contracted by solid solution of Si atom so that when the gradient of the Si concentration is formed in thickness direction by decreasing the Si content in the central portion, tensile stress is generated in the surface layer portion of the steel sheet. This tensile stress has an effect of reducing the iron loss so that the large improvement of the magnetic properties is expected by forming the gradient of the Si concentration. To obtain such an effect, the difference between maximum value of Si concentration at the surface layer in the sheet thickness and minimum value of Si concentration at the central portion in the sheet thickness is preferable to be not less than 0.5 mass %. More preferably, the maximum value of the Si concentration is not less than 6.2 mass %, and the difference between the maximum value and the minimum value is not less than 1.0 mass %.

The balance other than C and Si comprises Fe and incidental impurities. However, it is preferable that Mn, Ni, Cr, Cu, P, Sn, Sb, Bi, Mo and Al are included in the following range for the purpose of improving hot workability, iron loss and magnetic properties such as magnetic flux and so on.

Mn: 0.005~1.0 Mass %

Mn is preferable to be included in a range of 0.005~1.0 mass % to improve workability in hot rolling. When it is less than 0.005 mass %, the effect of improving the workability is small, while when it exceeds 1.0 mass %, the saturation magnetic flux density lowers.

Ni: 0.010~1.50 Mass %

Ni is an element that improves magnetic properties and is preferable to be included in a range of 0.010~1.50 mass %. When it is less than 0.010 mass %, the effect of improving the magnetic properties is small, while when it exceeds 1.50 mass %, the saturation magnetic flux density lowers.

One or More Selected from Cr: 0.01~0.50 Mass %, Cu: 0.01~0.50 Mass %, P: 0.005~0.50 Mass % and Al: 0.02~6.0 Mass %

Each is an element effective in reducing iron loss, and it is preferable to include one or more of these elements in the above ranges to obtain such an effect. When the content is less than the lower limit, there is no effect of reducing the iron loss, while when it exceeds the upper limit, the saturation magnetic flux density decreases.

One or More Selected from Sn: 0.005~0.50 Mass %, Sb: 0.005~0.50 Mass %, Bi: 0.005~0.50 Mass % and Mo: 0.005~0.100 Mass %

Each is an element effective in improving the magnetic flux density, and it is preferable to include one or more of these elements in the above ranges to obtain such an effect. When the content is less than the lower limit, there is no effect in improving the magnetic flux density, while when it exceeds the upper limit, the saturation magnetic flux density inversely decreases.

The texture of the electrical steel sheet will now be described.

It is necessary that the main orientation in the texture is <111>//ND and an intensity of the main orientation is not less than 5. As previously mentioned, <111>//ND orientation is a hardly-magnetizable orientation existing no <100> axis on the sheet surface as an axis of easy magnetization so that, as this orientation is developed, the DC superimposition property becomes good, but when the intensity of <111>//ND orientation is less than 5, such an effect is not sufficiently obtained. Intensity of <111>//ND can be determined by investigating the texture of the steel sheet by X-ray diffraction pole figure analysis, calculating its ODF, and averaging the value $\phi 1$ represented by Bunge's type from 0° to 90° at $\Phi$=55° and $\phi 2$=45°. Moreover, the preferable intensity of <111>//ND is not less than 6.5.

It is further preferable that an intensity of {111}<112> orientation in <111>//ND orientation is not less than 10. Since {111}<112> orientation is a typical orientation in <111>//ND orientation, when the intensity of {111}<112> orientation is made to not less than 10, the intensity of <111>//ND orientation can be surely made to not less than 5. More preferably, the intensity of {111}<112> orientation is not less than 13.

It is also preferable that an intensity of {310}<001> orientation is not more than 3. Since {310}<001> orientation has an axis of easy magnetization on the sheet surface as previously mentioned, it is preferable to make the intensity smaller for the improvement of the DC superimposition property. More preferably, the intensity of {310}<001> orientation is not more than 2.

The production method of the electrical steel sheet will be described below.

The electrical steel sheet can be produced by utilizing the general production method of electrical steel sheets. That is, steel adjusted to the aforementioned given chemical composition is melted to form a steel slab, which is subjected to hot rolling, hot band annealing of a hot rolled sheet, if necessary, and single cold rolling or more than two cold rollings applying intermediate annealing therebetween to form a cold rolled steel sheet having a final thickness, and then the cold rolled sheet is subjected to final annealing and coated with an insulating film, if necessary.

The method of producing the steel slab from the molten steel may be either an ingot making-slabbing method or a continuous casting method, or may be a method wherein a thin cast sheet having a thickness of not more than 100 mm is produced by direct casting. The steel slab is usually supplied to the hot rolling by reheating, but may be directly hot rolled without reheating after the casting. Moreover, the thin cast sheet may be subjected to hot rolling, or may be directly subjected to subsequent steps without hot rolling.

Moreover, the hot rolled sheet may be subjected to a hot band annealing, but is desirable to be not subjected to the hot band annealing. Because, as shown in FIG. 1, the DC superimposition property is good when the hot rolled sheet is not subjected to the hot band annealing.

After the hot rolling or after the hot band annealing, the hot rolled sheet is subsequently subjected to the single cold rolling or more than two cold rollings applying the intermediate annealing therebetween to provide a cold rolled sheet having a final thickness. Moreover, it is desirable to conduct the cold rolling at a lower temperature because <111>//ND orientation increases. Also, the final thickness (finish thickness) of the steel sheet is desirable to be thinner in view of reducing the iron loss and is preferably not more than 0.20 mm, more preferably not more than 0.10 mm. Furthermore, from the viewpoint of increasing <111>//ND orientation, the rolling reduction of the final cold rolling is preferable to be not less than 70%.

Thereafter, the sheet is subjected to final annealing. In this case, it is preferable that siliconizing is conducted by a known method to increase Si content in steel to reduce the iron loss. In the siliconizing treatment, it is preferable to form such a gradient of Si concentration that the concentration is high at the surface layer portion and low at the central portion in thickness direction.

As mentioned above, the electrical steel sheet having a highly developed <111>//ND orientation is obtained by a production method opposing that of a conventional electrical steel sheet, for example, a method wherein the annealing of the hot rolled sheet or the intermediate annealing is not conducted, a method wherein the cold rolling is carried out at a low temperature (for example, the temperature of the steel sheet is cooled to not higher than 10° C. by spraying a greater amount of lubricant oil or cooling water) and the cold rolling reduction is as high as about 96%, or the like, and cannot be easily obtained by the conventional technique.

EXAMPLE 1

A steel having a chemical composition containing C: 0.0047 mass %, Si: 1.24 mass % and Mn: 0.15 mass % and the balance being Fe and incidental impurities is melted and continuously cast to form a steel slab. Thereafter, the steel slab is heated to 1220° C. and hot rolled to form a hot rolled sheet having a thickness of 1.8 mm. Then, the hot rolled sheet is rendered into a cold rolled sheet having a final thickness of 0.10 mm under the following three conditions:

Condition A: The hot rolled sheet is subjected to a hot band annealing of 1050° C.×75 seconds, a first cold rolling to an intermediate thickness of 1.0 mm, an intermediate annealing of 1000° C.×30 seconds and a second cold rolling to form a cold rolled sheet having a final thickness of 0.10 mm.

Condition B: The hot rolled sheet is subjected to a hot band annealing of 1050° C.×75 seconds and then a single cold rolling to form a cold rolled sheet having a final thickness of 0.10 mm.

Condition C: The hot rolled sheet is subjected to a single cold rolling without a hot band annealing to form a cold rolled sheet having a final thickness of 0.10 mm.

Then, three kinds of the cold rolled sheets produced under the different conditions are subjected to siliconizing (final annealing) of 1150° C.×60 seconds in an atmosphere of 10 vol % $SiCl_4$+90 vol % Ar gas. The steel sheet after the siliconizing has a Si concentration changed in thickness direction, wherein a maximum value of Si concentration at the surface layer portion of the steel sheet is 6.5 mass % and a minimum value of Si concentration at the central portion in thickness is 1.3 mass % approximately equal to that of the raw steel material (difference between the maximum value and the minimum value is 5.2 mass %) and an average Si concentration in full thickness is 2.9 mass %. Moreover, there are substantially no differences in the Si concentration and the distribution of Si concentration among the above production conditions A~C.

A core for a reactor is prepared by using each of the above three steel sheets, and the DC superimposition property is measured according to a method described in JIS C5321. Moreover, the core for the reactor has a weight of 900 g and is provided in two places with gaps of 1 mm, and the measured DC superimposition property is evaluated by a direct current value when an inductance is decreased to ½ of an initial inductance (inductance at a direct current of 0 [A]).

Also, samples are taken out from the three steel sheets and textures thereof are investigated by X-ray diffraction pole figure analysis and their ODF are calculated by the discrete method, from which intensities of <111>//ND orientation, {111}<112> orientation and {310}<001> orientation are calculated.

The measured results of the DC superimposition property and intensity of orientations in the texture are shown in Table 1. As seen from Table 1, our steel sheets produced under the conditions B and C have an intensity of <111>//ND orientation of not less than 5 and are good in the DC superimposition property.

TABLE 1

| Condition | Intensity of product sheet <111>//ND | {310}<001> | {111}<112> | Current value decreasing initial inductance to ½ (A) | Remarks |
|---|---|---|---|---|---|
| A | 1.9 | 7.0 | 3.1 | 33 | Comparative Example |
| B | 5.5 | 2.6 | 7.6 | 62 | Example |
| C | 7.2 | 1.3 | 13.5 | 89 | Example |

EXAMPLE 2

A steel containing Si: 1.1~4.5 mass % and other chemical components shown in Table 2 and the balance being Fe and incidental impurities is melted and continuously cast to form a steel slab. Thereafter, the steel slab is heated to 1200° C. and hot rolled to form a hot rolled sheet having a thickness of 1.8 mm. Then, the hot rolled sheet is pickled for removing scales and subjected to a single cold rolling to form a cold rolled sheet having a final thickness of 0.10 mm. Thereafter, the cold rolled sheet is subjected to siliconizing (final annealing) of 1150° C.×300 seconds in an atmosphere of 15 vol % $SiCl_4$+85 vol % $N_2$ gas. However, steel sheet No. 2 in Table 2 is subjected to final annealing in an atmosphere of 100 vol % $N_2$ gas without siliconizing. Moreover, the steel sheets after the siliconizing have substantially a uniform Si concentration in thickness direction and their Si contents are also shown in Table 2. As a result of analysis on ingredients other than Si for confirmation, the steel sheets are confirmed to have substantially the same chemical composition as in the starting materials.

A core for a reactor is prepared by using each of the above various steel sheets, and the DC superimposition property is measured according to a method described in JIS C5321. Moreover, the core for the reactor has a weight of 900 g and is provided in two places with gaps of 1 mm, and the measured DC superimposition property is evaluated by a direct current value when an inductance is decreased to ½ of an initial inductance (inductance at a direct current of 0 [A]).

The measured results on the DC superimposition property are also shown in Table 2. As seen from the same table, our steel sheets satisfying the chemical composition are good in the DC superimposition property.

For confirmation, samples are taken out from the steel sheets after the siliconizing, and textures thereof are investigated by X-ray diffraction pole figure analysis and their ODF are calculated by the discrete method, from which an intensity of each orientation is calculated. As a result, the steel sheets other than steel sheet No. 2 are confirmed to have intensities of not less than 5 in <111>//ND orientation, not less than 10 in {111}<112> orientation and not more than 3 in {310}<001> orientation.

TABLE 2

| Steel sheet No. | Chemical composition of product sheet (mass %) C | Si | Other ingredients | Current value decreasing initial inductance to ½ (A) | Remarks |
|---|---|---|---|---|---|
| 1 | 0.0065 | 4.82 | — | 48 | Example |
| 2 | 0.0060 | 1.12 | — | 28 | Comparative Example |
| 3 | 0.0036 | 4.93 | Mn: 0.32, P: 0.013 | 52 | Example |
| 4 | 0.0045 | 4.11 | Mn: 0.10, Sb: 0.03, Cr: 0.07 | 51 | Example |
| 5 | 0.0075 | 7.23 | Mn: 0.06, Ni: 0.06, Bi: 0.07 | 43 | Example |
| 6 | 0.0022 | 5.58 | Al: 0.02, Mo: 0.12 | 56 | Example |
| 7 | 0.0055 | 3.69 | Cu: 0.08 | 55 | Example |
| 8 | 0.0030 | 6.49 | Sn: 0.10, Mn: 0.06 | 70 | Example |

EXAMPLE 3

A steel having a chemical composition containing C: 0.0062 mass %, Si: 2.09 mass %, Mn: 0.08 mass %, P: 0.011 mass %, Cr: 0.03 mass %, Sb: 0.035 mass % and the balance being Fe and incidental impurities is melted and continuously cast to form a steel slab. Thereafter, the steel slab is heated to 1150° C. and hot rolled to form a hot rolled sheet having a thickness of 2.2 mm. Then, the hot rolled sheet is pickled for removing scales and subjected to a single cold rolling to form a cold rolled sheet having a final thickness of 0.10 mm. Thereafter, the cold rolled sheet is subjected to siliconizing (final annealing) of 1200° C.×30 seconds in an atmosphere of 10 vol % $SiCl_4$+90 vol % Ar gas and further to diffusion annealing keeping 1200° C. for a time described in Table 3 for promoting diffusion of Si into the interior to change a gradient of Si concentration in $N_2$ atmosphere. However, since the siliconizing conditions are same in all steel sheets, average Si concentration in full thickness has no difference and is 3.70 mass %.

A core for a reactor is prepared by using the thus obtained steel sheets, and the DC superimposition property is measured according to a method described in JIS C5321. Moreover, the core for the reactor has a weight of 900 g and is provided in two places with gaps of 1 mm, and the measured DC superimposition property is evaluated by a direct current value when an inductance is decreased to ½ of an initial inductance (inductance at a direct current of 0 [A]). The results are also shown in Table 3.

Further, the distribution of Si concentration in the thickness direction of the steel sheet is measured by an EPMA to determine maximum value and minimum value of Si content and a difference therebetween (ΔSi), which are also shown in Table 3. For confirmation, samples are taken out from the steel sheets after the siliconizing, and textures thereof are investigated by X-ray diffraction pole figure analysis and their ODF are calculated by the discrete method, from which an intensity of each orientation is calculated. As a result, the steel sheets are confirmed to have intensities of not less than 5 in <111>//ND orientation, not less than 10 in {111}<112> orientation and not more than 3 in {310}<001> orientation.

As seen from Table 3, the DC superimposition property of our steel sheets satisfying the conditions are good. Among them, the steel sheet satisfying the conditions that the maximum value of Si content is not less than 5.5 mass % and ΔSi is not less than 0.5 mass % is further good in the DC superimposition property.

TABLE 3

| Steel sheet No. | Annealing time (sec) | Si maximum value (mass %) | Si minimum value (mass %) | ΔSi (mass %) | Current value decreasing initial inductance to ½ (A) | Remarks |
|---|---|---|---|---|---|---|
| 1 | 0 | 7.01 | 2.11 | 4.90 | 90 | Example |
| 2 | 20 | 6.54 | 2.23 | 4.31 | 92 | Example |
| 3 | 40 | 5.97 | 2.45 | 3.52 | 89 | Example |
| 4 | 60 | 5.51 | 2.60 | 2.91 | 88 | Example |
| 5 | 100 | 4.77 | 2.87 | 1.90 | 83 | Example |
| 6 | 150 | 4.39 | 3.15 | 1.24 | 81 | Example |
| 7 | 200 | 4.02 | 3.45 | 0.57 | 75 | Example |
| 8 | 500 | 3.70 | 3.70 | 0.00 | 68 | Example |

The invention claimed is:

1. An electrical steel sheet having a chemical composition comprising C: less than 0.010 mass %, Si: 1.5~10 mass % and the balance being Fe and incidental impurities, wherein a main orientation in a texture of a steel sheet is <111>//ND, an intensity ratio relative to randomly oriented specimen of the main orientation is not less than 5, an intensity ratio relative to randomly oriented specimen of {111}<112> orientation is not less than 10, and a final thickness of the steel sheet is not more than 0.20 mm.

2. The electrical steel sheet according to claim 1, wherein an intensity ratio relative to randomly oriented specimen of {310}<001> orientation is not more than 3.

3. The electrical steel sheet according to claim 2, wherein Si concentration has a gradient higher at a side of a surface layer and lower at a central portion in a thickness direction and a maximum value of the Si concentration has a distribution such that a maximum value of Si concentration at a side of a surface layer in the thickness direction is not less than 5.5 mass % and Si concentration at a central portion in the thickness direction is lower by not less than 0.5 mass % than the maximum value.

4. The electrical steel sheet according to claim 2, wherein in addition to the above chemical composition, the electrical steel sheet of the invention contains one or more of Mn: 0.005~1.0 mass %, Ni: 0.010~1.50 mass %, Cr: 0.01~0.50 mass %, Cu: 0.01~0.50 mass %, P: 0.005~0.50 mass %, Sn: 0.005~0.50 mass %, Sb: 0.005~0.50 mass %, Bi: 0.005~0.50 mass %, Mo: 0.005~0.100 mass % and Al: 0.02~6.0 mass %.

5. The electrical steel sheet according to claim 3, wherein in addition to the above chemical composition, the electrical steel sheet of the invention contains one or more of Mn: 0.005~1.0 mass %, Ni: 0.010~1.50 mass %, Cr: 0.01~0.50 mass %, Cu: 0.01~0.50 mass %, P: 0.005~0.50 mass %, Sn: 0.005~0.50 mass %, Sb: 0.005~0.50 mass %, Bi: 0.005~0.50 mass %, Mo: 0.005~0.100 mass % and Al: 0.02~6.0 mass %.

6. The electrical steel sheet according to claim 1, wherein Si concentration has a gradient higher at a side of a surface layer and lower at a central portion in a thickness direction and a maximum value of the Si concentration has a distribution such that a maximum value of Si concentration at a side of a surface layer in the thickness direction is not less than 5.5 mass % and Si concentration at a central portion in the thickness direction is lower by not less than 0.5 mass % than the maximum value.

7. The electrical steel sheet according to claim 6, wherein in addition to the above chemical composition, the electrical steel sheet of the invention contains one or more of Mn: 0.005~1.0 mass %, Ni: 0.010~1.50 mass %, Cr: 0.01~0.50 mass %, Cu: 0.01~0.50 mass %, P: 0.005~0.50 mass %, Sn: 0.005~0.50 mass %, Sb: 0.005~0.50 mass %, Bi: 0.005~0.50 mass %, Mo: 0.005~0.100 mass % and Al: 0.02~6.0 mass %.

8. The electrical steel sheet according to claim 1, wherein in addition to the above chemical composition, the electrical steel sheet of the invention contains one or more of Mn: 0.005~1.0 mass %, Ni: 0.010~1.50 mass %, Cr: 0.01~0.50 mass %, Cu: 0.01~0.50 mass %, P: 0.005~0.50 mass %, Sn:

0.005~0.50 mass %, Sb: 0.005~0.50 mass %, Bi: 0.005~0.50 mass %, Mo: 0.005~0.100 mass % and Al: 0.02~6.0 mass %.

* * * * *